US007442892B2

(12) United States Patent
Ishiguro

(10) Patent No.: US 7,442,892 B2
(45) Date of Patent: Oct. 28, 2008

(54) LATCH RELEASE OPERATING APPARATUS

(75) Inventor: Katsuyuki Ishiguro, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 332 days.

(21) Appl. No.: 11/289,462

(22) Filed: Nov. 30, 2005

(65) Prior Publication Data

US 2006/0119113 A1 Jun. 8, 2006

(30) Foreign Application Priority Data

Dec. 7, 2004 (JP) ..... 2004-354534

(51) Int. Cl.
*H01H 3/00* (2006.01)

(52) U.S. Cl. ..... 200/329; 200/302.2

(58) Field of Classification Search ... 200/302.1–302.3, 200/341–345, 329

See application file for complete search history.

(56) References Cited

U.S. PATENT DOCUMENTS 5,382,767 A * 1/1995 Takano et al. ..... 200/531
5,990,431 A * 11/1999 Wright ..... 200/302.3
6,573,466 B1 * 6/2003 Rapp et al. ..... 200/302.3
6,626,473 B1 * 9/2003 Klein et al. ..... 292/347
6,794,592 B1 * 9/2004 Liu et al. ..... 200/302.3
6,897,389 B2 * 5/2005 Li ..... 200/341

FOREIGN PATENT DOCUMENTS

JP 3534068 B2 3/2004

* cited by examiner

*Primary Examiner*—Michael A Friedhofer
*Assistant Examiner*—Lisa N Klaus
(74) *Attorney, Agent, or Firm*—Foley & Lardner LLP

(57) ABSTRACT

A latch release operating apparatus includes a switch unit that has a push button on its switch main unit and that is turned ON for releasing a latch state of a door when the push button is pressed down; a base member that holds the switch unit via the switch main unit such that the push button faces the outside; and a waterproof cover member that is attached on a surface of the base member and that covers the push button. A peripheral edge of the cover member is held between the base member and a door outer panel, and the switch unit is mounted on the door outer panel via the base member such that the push button is operable from an outside of the door outer panel via the cover member.

7 Claims, 8 Drawing Sheets

LATCH RELEASE OPERATING APPARATUS

BACKGROUND OF THE INVENTION

1. Field of the Invention

The present invention relates to an apparatus to be operated when a latch state of a door is released.

2. Description of the Related Art

In some vehicles, a release actuator is driven when a latch of a door such as a trunk lid is released. A latch release operating apparatus applied to such vehicles generally includes a switch unit that drives the release actuator. For example, Japanese Patent No. 3534068 discloses a latch release operating apparatus, in which when an operating unit projects to the outside through an opening of a door outer panel, a door handle is pivoted to a base member. A switch unit is disposed at a portion positioned inward with respect to the door outer panel, and when the operation unit is pivotally operated, pressing a portion of the door handle turns ON the switch unit.

In a vehicle with the latch release operating apparatus, when an operator or a vehicle passenger pivotally operates the operation unit of the door handle to turn ON the switch unit, the release actuator is driven so that a door latch apparatus is operated for releasing. Accordingly, an operation force to be applied to the latch release operating apparatus can be reduced, as compared with a conventional latch release operating apparatus in which a door latch state of a door latch apparatus is released via a wire cable or a link rod.

When such a latch release operating apparatus is applied to a vehicle, waterproofing must be considered sufficiently. That is, it is necessary to reliably prevent water such as rainwater from entering through an opening provided in a door outer panel.

To achieve a desired waterproof function in the latch release operating apparatus described in Japanese Patent No. 3534068, an operation unit of a door handle and a load receiving member that bears an operation load when a door is opened are covered with a waterproof cover, and a peripheral edge of the waterproof cover is sandwiched between the door outer panel and the base member.

However, the operation unit of the door handle and the load receiving member largely project from an outer surface of the door outer panel toward the outside. Therefore, the waterproof cover that covers the operation unit of the door handle and the load receiving member must be also constituted to budge from the outer surface of the door outer panel to the outside in a bag shape. Therefore, the waterproof cover may come in contact with a foreign object even at times other than while operating the door handle. Specifically, tools such as car washing tools my come in contact with the waterproof cover during maintenance, checking, or washing of the car. Furthermore, in view of a swinging operability of a door handle, the waterproof cover may be deformed due to a swinging operation of the door handle. Therefore, the waterproof cover must be thin, which makes it difficult to maintain a sufficient damage resistance property. Accordingly, in the conventional latch release operating apparatus, the waterproof cover is likely to be damaged relatively easily and water enters into the apparatus.

SUMMARY OF THE INVENTION

It is an object of the present invention to at least solve the problems in the conventional technology.

According to an aspect, a latch release operating apparatus includes a switch unit that includes a switch main unit having a push button, and that is turned ON for releasing a latch state of a door when the push button is pressed down with respect to the switch main unit; a base member that holds the switch unit via the switch main unit such that the push button faces the outside from a surface of the base member; and a cover member that is waterproof, that is attached on the surface of the base member, and that covers the push button; wherein a peripheral edge of the cover member is held between the base member and a door outer panel, and the switch unit is mounted on the door outer panel via the base member such that the push button is operable from an outside of the door outer panel via the cover member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
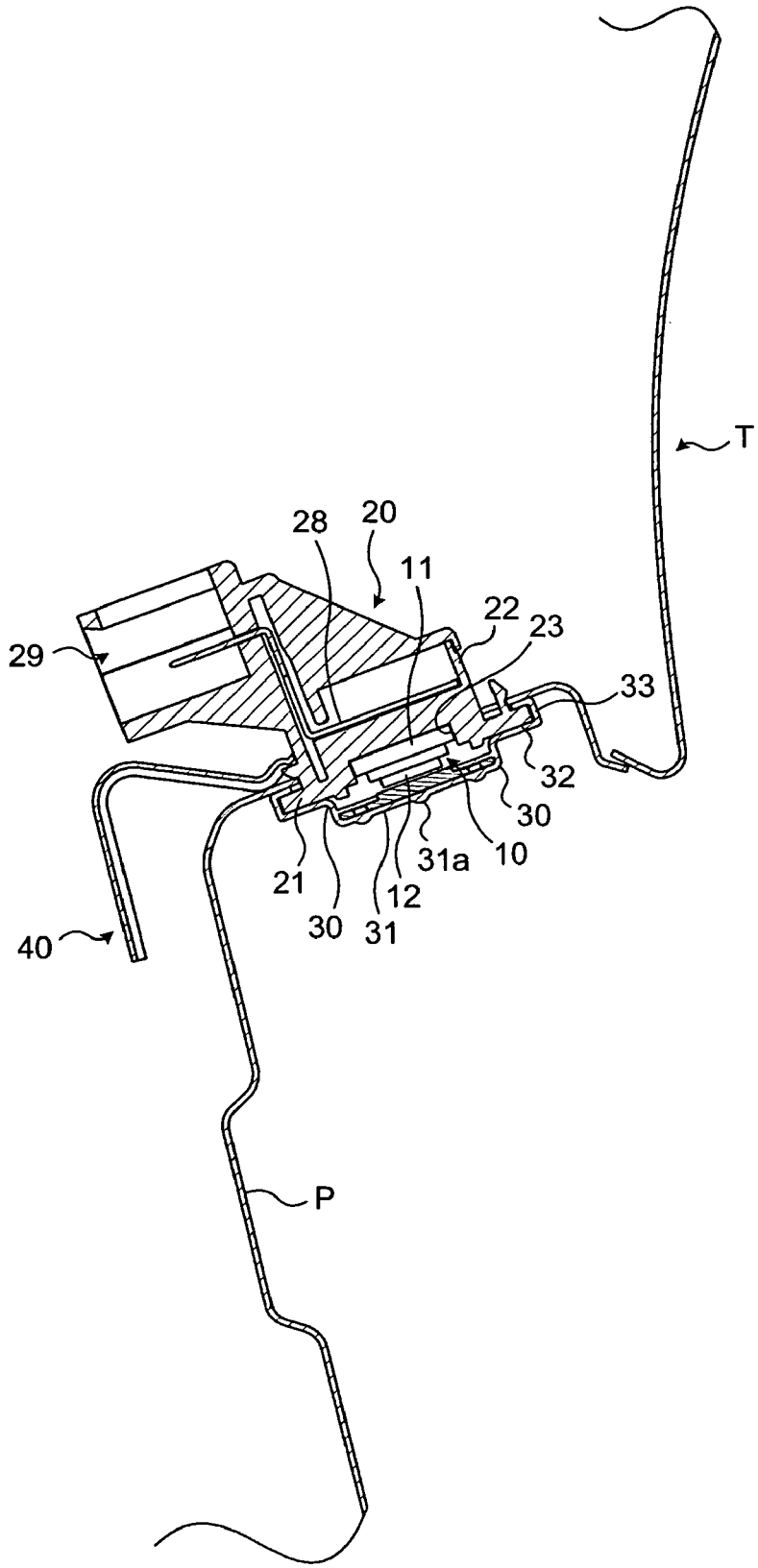
FIG. 1 is a sectional side view of relevant parts of a vehicle using a latch release operating apparatus according to an embodiment of the present invention.
Figure 2:
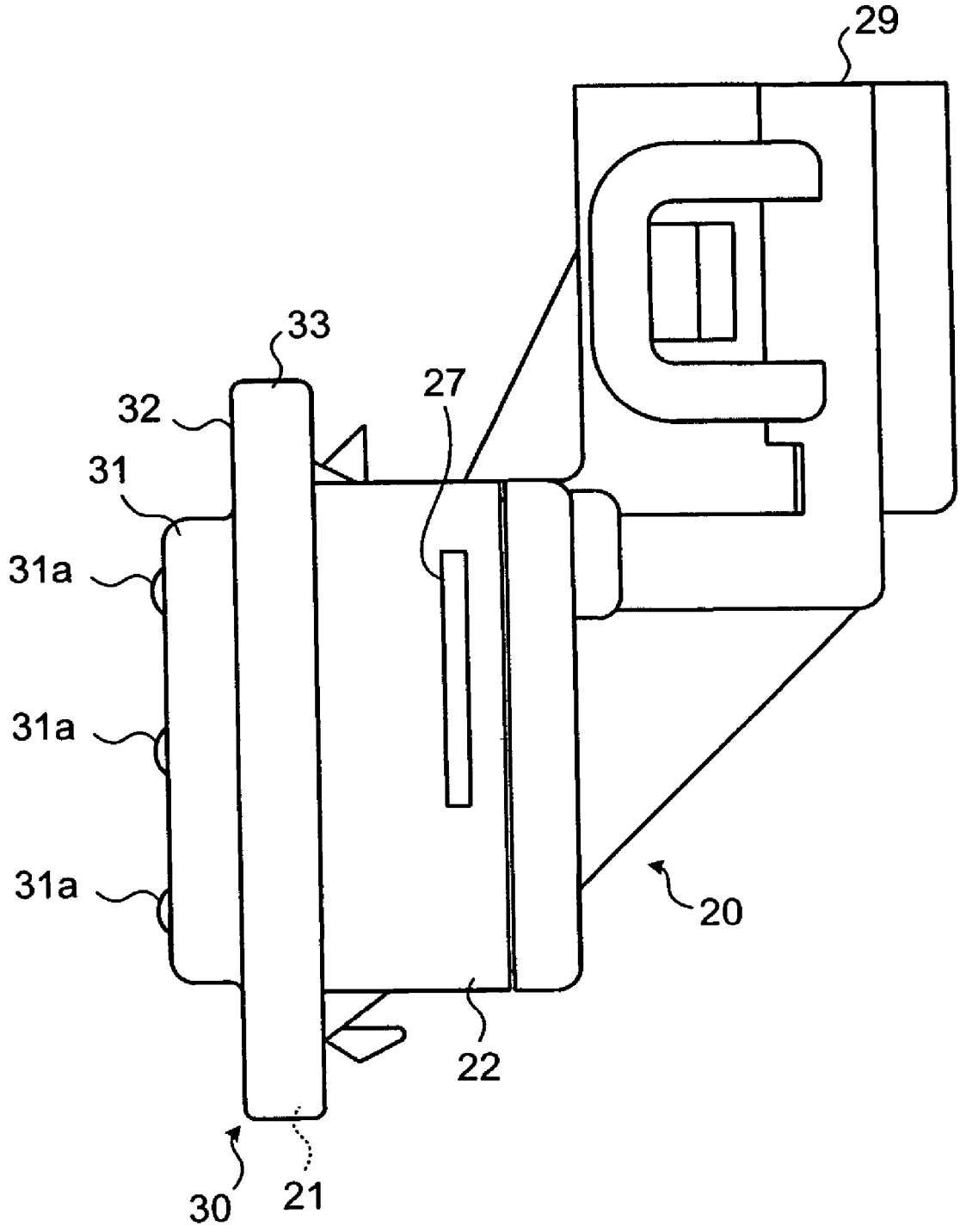
FIG. 2 is a side view of the latch release operating apparatus shown in FIG. 1.
Figure 3:
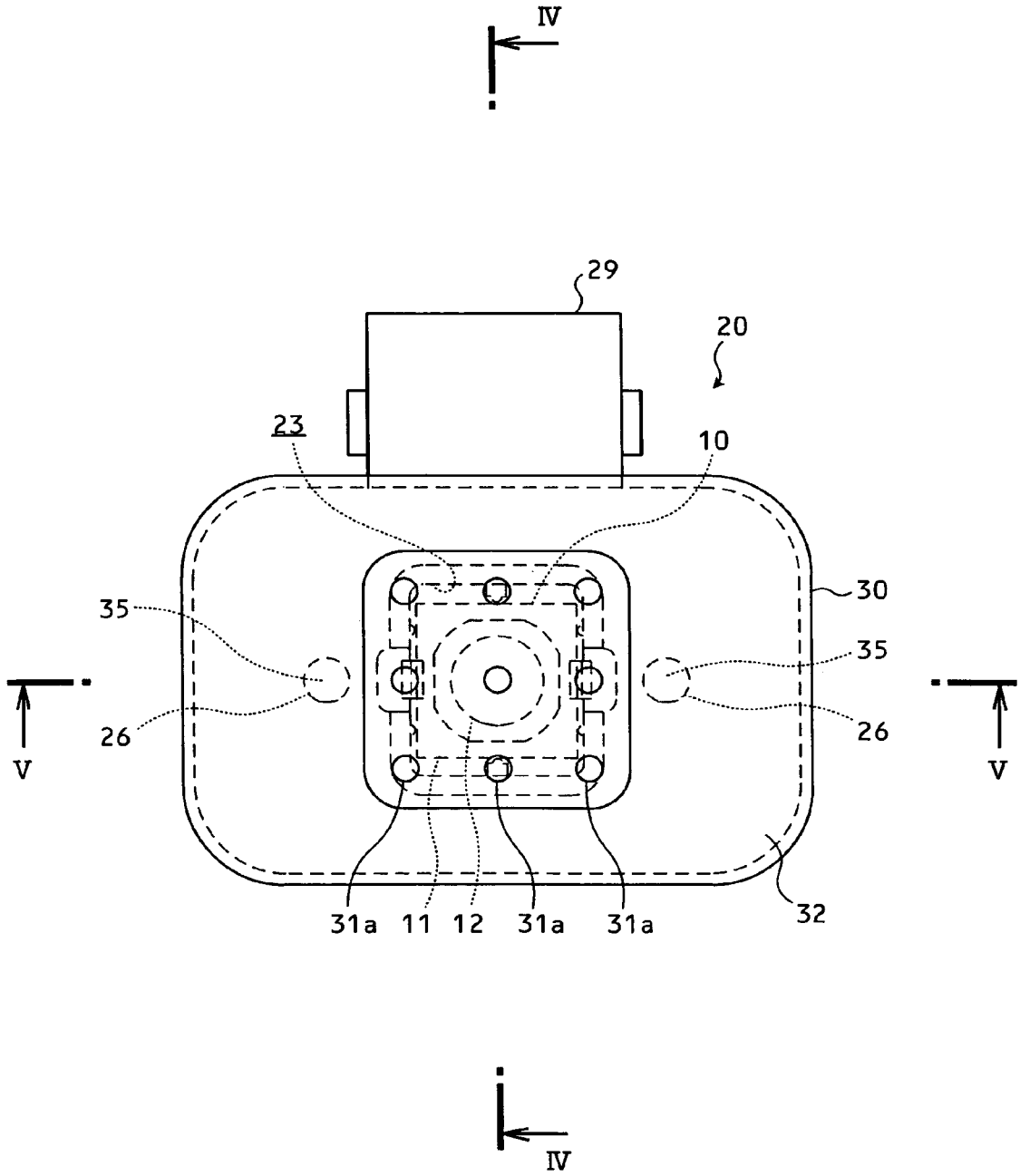
FIG. 3 is a front view of the latch release operating apparatus shown in FIG. 1.

FIG. 1 depicts relevant parts of a vehicle to which a latch release operating apparatus according to an embodiment of the present invention is applied, and FIGS. 2 to 8 show detailed constitution of the latch release operating apparatus shown in FIG. 1. The latch release operating apparatus shown here is provided to a trunk lid (a door) T that is used for opening and closing a trunk room in a vehicle such as a four-wheel automobile, and it includes a switch unit 10 and a base member 20.

The switch unit 10 is a so-called "tact switch", and it includes a switch main unit 11 and a push button 12. In the embodiment, the switch main unit 11 is formed to have an approximately square and thin outer shape, and the push button 12 having a thin cylindrical shape projects from an upper face of the switch main unit 11. The switch unit 10 is normally OFF, while it is turned ON when the push button 12 is pushed towards the switch main unit 11. By eliminating a pressing operation force to the push button 12, the push button 12 returning to the earlier state, due to action of a return spring (not shown) housed in the switch unit 10, so that the switch unit 10 is put in OFF state again.

The base member 20 is molded using relatively hard synthetic resin with electrical insulating property, and it includes a plate portion 21 and a box portion 22.

The plate portion 21 is an approximately rectangular plate-shaped portion, and it holds the switch unit 10 in a receiving recess portion 23 arranged at the center of a surface 21*a* of the plate portion 21. The receiving recess portion 23 is slightly larger in length and breadth than the switch main unit 11 of the switch unit 10, slightly smaller in depth than a total height of the switch unit 10 including the push button 12, and it receives the switch unit 10 such that the push button 12 slightly projects from the surface 21*a* of the plate portion 21.

Figure 5:
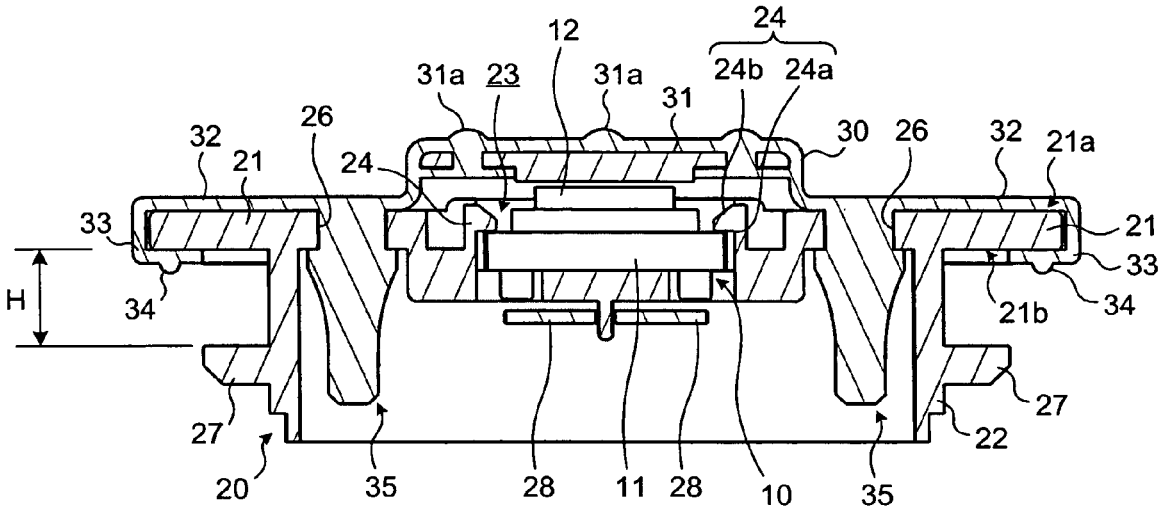
FIG. 5 is a sectional view of the latch release operating apparatus taken along line V-V shown in FIG. 3.
Figure 6:
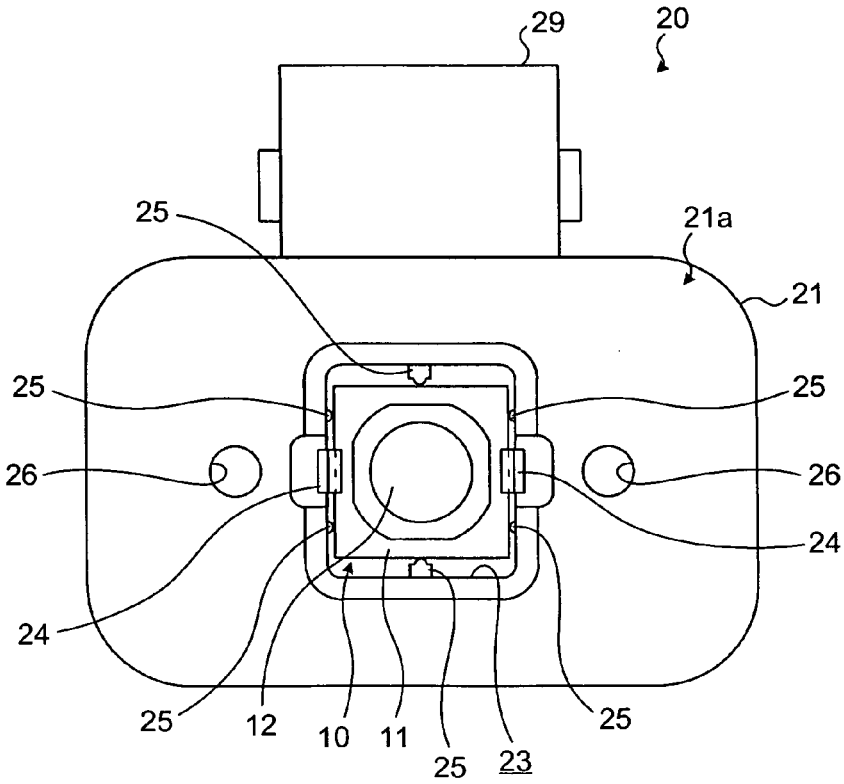
FIG. 6 is a front view of the latch release operating apparatus shown in FIG. 1 without a cover member.
Figure 7:
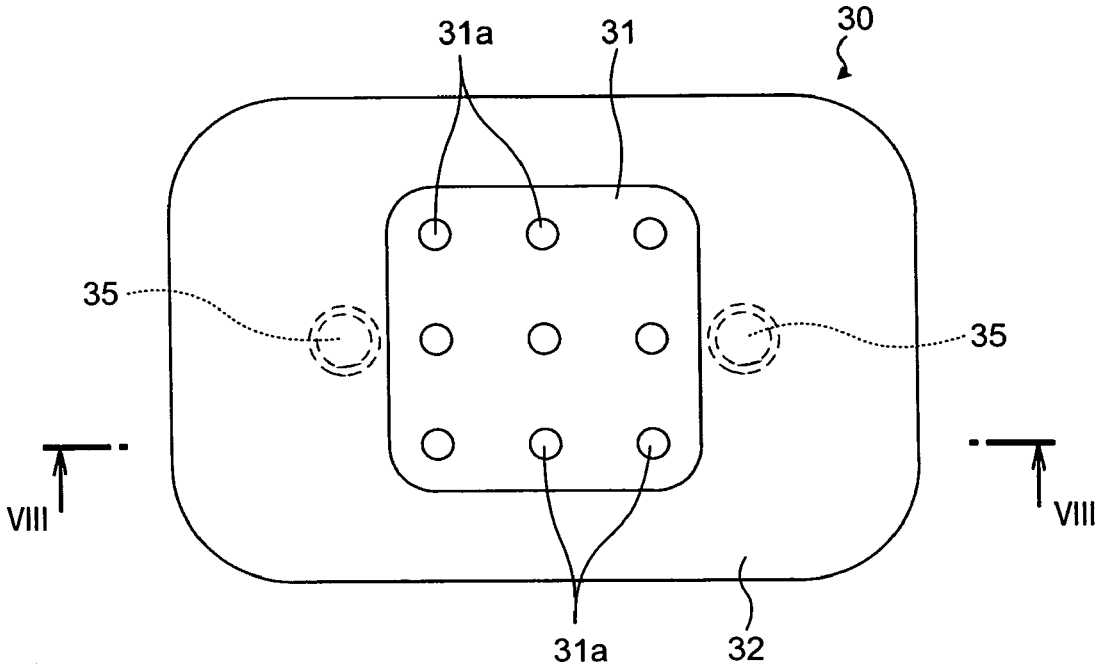
FIG. 7 is a front view of the cover member of the latch release operating apparatus shown in FIG. 1.

As shown in FIGS. 5 and 6, the receiving recess portion 23 includes retaining pawls 24 paired at opposing portions inside thereof, and it also has positioning ribs 25 of inner faces of respective walls thereof. Each of the retaining pawls 24 has base pieces 24*a* extending from a bottom face of the receiving recess portion 23 in a direction of an opening thereof, and pawls 24*b* extending from extension ends of the respective base pieces 24*a* inwardly towards each other. The switch unit 10 is restricted from moving away from the receiving recess portion 23 by causing the respective pawls 24*b* to hold on to an upper face of the switch main unit 11. The positioning ribs 25 are projecting portions with small width extending in the direction of the opening of the receiving recess portion 23, and they abut on circumferential faces of the switch main unit 11 to restrict the switch unit 10 from moving along the plate portion 21 relative to the base member 20. Though not shown, terminal through-holes for allowing insertion of terminals of the switch unit 10 to a back face 21*b* of the plate portion 21 are formed at proper portions of a bottom wall of the receiving recess portion 23.

As shown in FIG. 5, a pair of mounting holes 26 is arranged in the plate portion 21 of the base member 20. The mounting holes 26 are circular holes extending through the plate portion 21, and are formed at both sides of the receiving recess portion 23.

The box portion 22 of the base member 20 is a box-shaped portion constituted on the back face 21*b* side of the plate portion 21, utilizing the plate portion 21 as one wall. Length and width of the box portion 22 are less than those of the plate portion 21. The box portion 22 is arranged at a central portion of the back face 21*b* of the plate portion 21 and surrounds a position corresponding to the receiving recess portion 23 and the pair of mounting holes 26 while maintaining an abutting face over a whole periphery of the back face 21*b* of the plate portion 21.

Figure 4:
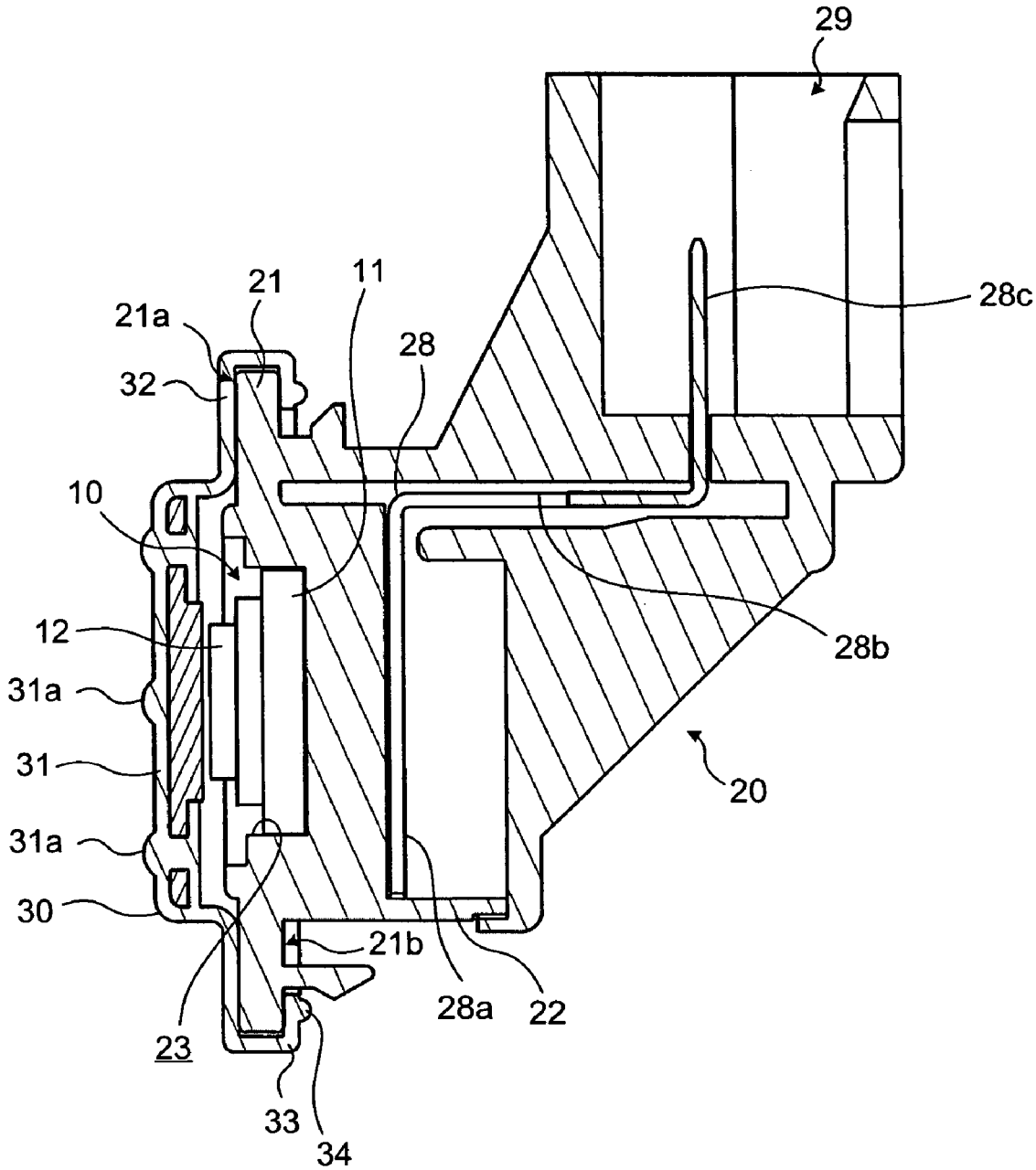
FIG. 4 is a sectional view of the latch release operating apparatus taken along line IV-IV shown in FIG. 3.

The box portion 22 has spring retaining portions 27 arranged at outer faces on both sides thereof, and includes terminal pieces 28 arranged internally. Each spring retaining portion 27 protrudes from an outer face of the box portion 22 along the plate portion 21 so as to maintain a predetermined flexing distance H from the back face 21*b* of the plate portion 21. Each terminal piece 28 is an electrically conductive member, and as shown in FIG. 4, includes a first piece portion 28*a* extending along the back face 21*b* of the plate portion 21, a second piece portion 28*b* extending from one end of the first piece portion 28*a* so as to bend approximately at a right angle in a direction away from the plate portion 21, and a third piece portion 28*c* that extends from an end of the second piece portion 28*b* so as to bend approximately at a right angle so as to project outward beyond a peripheral face of the plate portion 21. The first piece portion 28*a* of the terminal piece 28 and a terminal of the switch unit 10 projecting toward the back face 21*b* side through the terminal through hole (not shown) are electrically connected to each other by soldering.

The box portion 22 includes a connector connecting portion 29. The connector connecting portion 29 is for constituting a connector utilizing the third piece portion 28*c* of the terminal piece 28 as a terminal, and it is formed so as to project from an end of the box portion 22 externally. Though not shown, in the embodiment, the base member 20 includes two parts attachable and detachable to each other such that the box portion 22 and the connector connecting portion 29 can be separated from each other.

On the other hand, the latch release operating apparatus includes a portion thereof that covers the plate portion 21 with a cover member 30. The cover member 30 is made from waterproof material having high elasticity, for example, ethylene-propylene rubber, and includes an operation unit 31, a base portion 32, and a mounting portion 33. The operation unit 31 covers a portion corresponding to the switch unit 10, and is rectangular in shape with a size sufficient to cover the opening of the receiving recess portion 23. The base portion 32 covers the surface 21*a* of the plate portion 21, and is continuous with a periphery of the operation unit 31. The mounting portion 33 covers a peripheral face of the plate portion 21 and a peripheral edge of the back face 21*b* of the plate portion 21 of the base member 20, and is continuous with the base portion 32. A lip portion 34 is arranged on a part of the mounting portion 33 that covers the peripheral edge of the back face 21*b* so as to extend over a whole circumference thereof. The lip portion 34 has a cross section projecting in semi-circular shape with a small diameter, and is formed as an endless portion.

As is understood from the figures, the cover member 30 is formed to have steps such that the operation unit 31 projects from the base portion 32, where a surface of the base portion 32 is formed smoothly, while a plurality of projections 31*a* are formed on a surface of the operation unit 31. For example, when a person touches the cover member 30 with his/her fingers, he/she can confirm a position of the operation unit 31, without visual confirmation, from a difference of touch between the base portion 32 and the operation unit 31 due to formation of the step between the base portion 32 and the operation unit 31, and the projections 31*a*.

Figure 8:
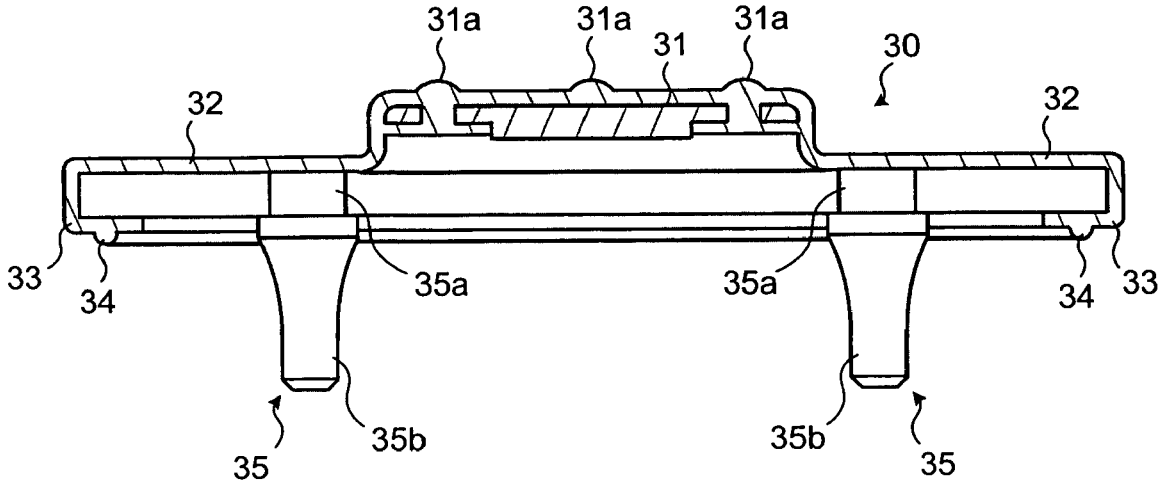
FIG. 8 is a sectional view of the latch release operating apparatus taken along line VIII-VIII shown in FIG. 7.

The cover member 30 is arranged at portions of a back face of the base portion 32 with a pair of mounting projection bodies 35 (see FIGS. 5 and 8). Each mounting projection body 35 includes a shaft portion 35*a* with a circular cross section, and a tapered retaining portion 35*b* formed so as to bulge from a distal end of the shaft portion 35*a* in a radially outward direction and subsequently gradually decrease in outer diameter toward a distal end thereof. The shaft portion 35*a* of the mounting projection body 35 is formed to have an outer diameter slightly smaller than an inner diameter of the mounting hole 26 formed in the plate portion 21. The retaining portion 35*b* is formed such that an outer diameter of a distal end thereof is slightly smaller than the inner diameter of the mounting hole 26, while an outer diameter of a base end thereof is larger than the inner diameter of the mounting hole 26. The mounting projection bodies 35 are inserted into the mounting holes 26, while the respective retaining portions 35*b* are being elastically deformed, and they are retained in such a state that the base portions of the retaining portions 35*b* are positioned on the back face 21*b* side of the plate portion 21.

In such a state, the base portions of the retaining portions 35*b* that have returned to their original outer diameters due to their elastically restoring forces, abut on the back face 21*b* of the plate portion 21 in an engaging manner, so that the cover member 30 can be prevented from falling off the base member 20 inadvertently. By pulling the mounting projection bodies out of the mounting holes 26, while flexing the retaining portions 35*b*, the respective mounting projection bodies 35 can be detached from the plate portion 21.

Figure 11A:
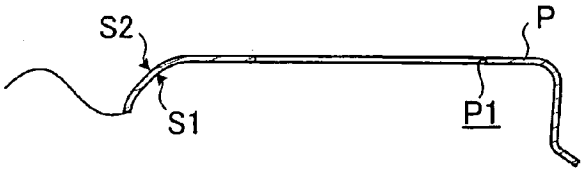
FIGS. 11A to 11D are conceptual diagrams of mounting steps of the latch release operating apparatus shown in FIG. 1 in order of mounting.

When the latch release operating apparatus constituted in the above manner is mounted on a door outer panel P of a trunk lid T, as shown in FIG. 11A, a mounting opening P1 is formed in the door outer panel P. The mounting opening P1 has such a size that the box portion 22 of the base member 20 can be inserted, and a whole periphery of the back face 21*b* of the plate portion 21 can abut on an outer surface S1 of the door outer panel P.

Figure 9:
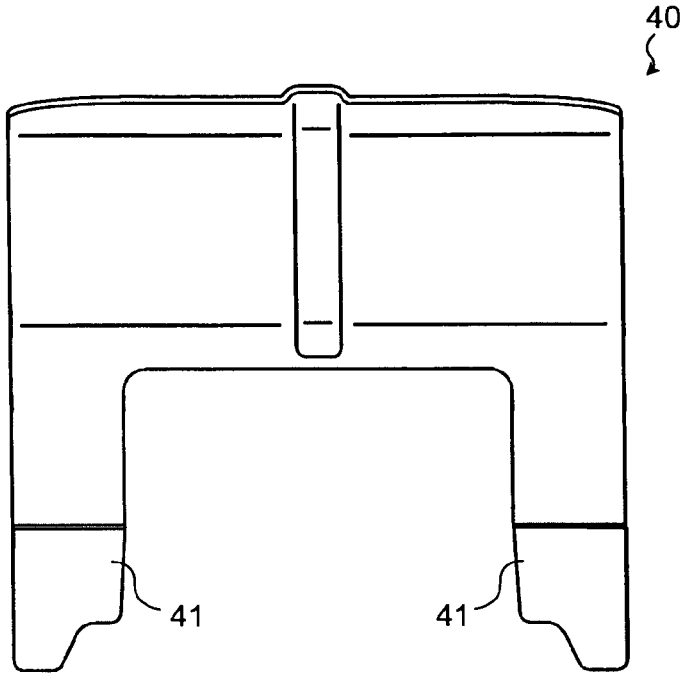
FIG. 9 is a conceptual diagram of a leaf spring used for mounting the latch release operating apparatus shown in FIG. 1.
Figure 10:
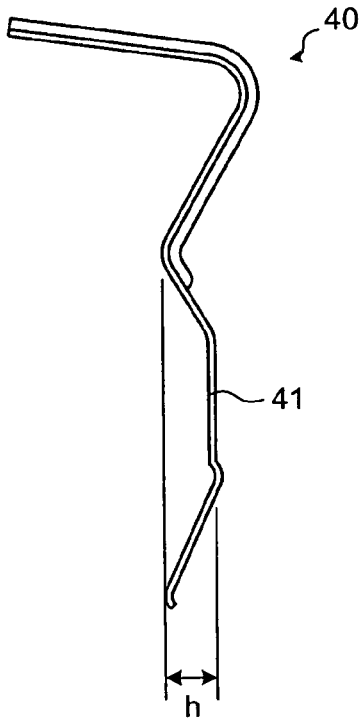
FIG. 10 is a side view of the leaf spring shown in FIG. 9.
Figure 11B:
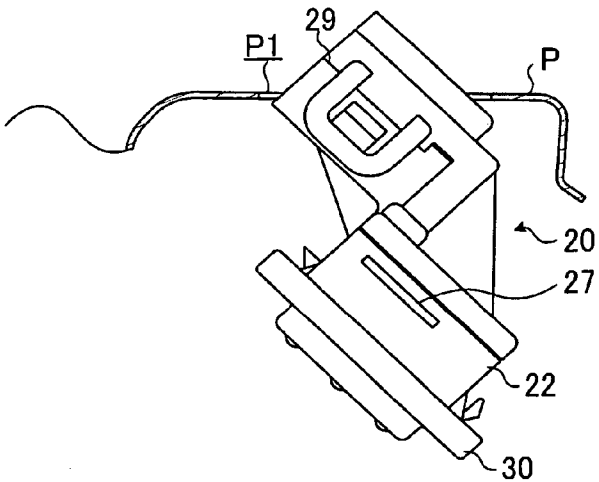
Figure 11C:
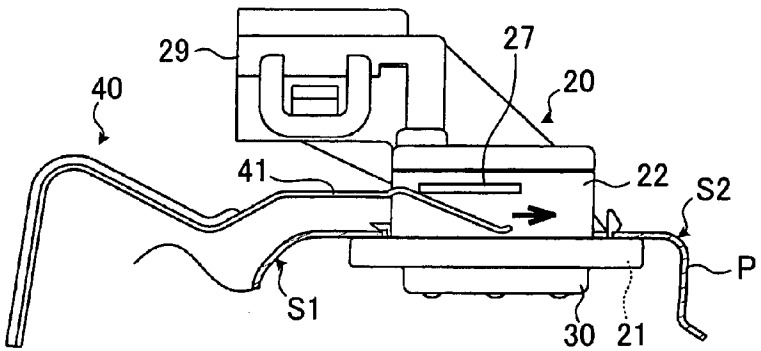
Figure 11D:
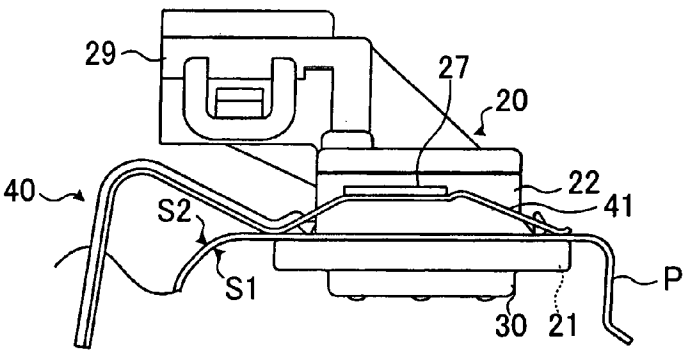

As shown in FIG. 11B, the connector connecting portion 29 and the box portion 22 are sequentially inserted through the opening P1 from the outside of the door outer panel P, and the back face 21*b* of the plate portion 21 is caused to abut on an inner face S2 of the door outer panel P. Furthermore, a leaf spring member 40 is interposed between the inner surface S2 of the door outer panel P and the spring retaining portions 27 arranged on the box portion 22 of the base member 20, so that from this state, the back face 21*b* of the plate portion 21 can be held in pressure contact with the outer surface S1 of the door outer panel P, as shown in FIG. 11D. As shown in FIGS. 9 and 10, the leaf spring member 40 is a resilient member having a pair of distal end spring portions 41. A distance between the distal end spring portions 41 is set such that the box portion 22 of the base member 20 can be disposed therebetween, while the plate portion 21 and the spring retaining portions 27 cannot be inserted therebetween. Each distal end spring portion 41 is set to have a height h, larger than the flexing distance H, from the back face 21*b* of the plate portion 21 to the spring retaining portion 27 in a normal state. Thus, it serves to press the inner surface S2 of the door outer panel P and the spring retaining portion 27 so as to separate the two from each other when interposed between the inner surface S2 of the door outer panel P and the spring retaining portion 27.

In the latch release operating apparatus mounted in the above manner, when the operation unit 31 of the cover member 30 is pressed down from the outside of the door outer panel P, the cover member 30 is deformed properly, so that the pressing of the push button 12 of the switch unit 10 is operated via the operation unit 31, and the switch unit 10 is put in ON state. Accordingly, when the connector connecting portion 29 is connected with a desired cable such that the switch unit 10 serves as an actuating switch for a release actuator, it is possible to drive the release actuator to release a latch state of the trunk lid T by a pressing operation of the switch unit 10.

In the latch release operating apparatus, however, since a portion thereof to be exposed outside the door outer panel P is completely covered with the cover member 30, and a portion of the mounting portion 33 of the cover member 30 that covers the peripheral edge of the back face 21*b* of the plate portion 21 is sandwiched between the plate portion 21 and the outer surface S1 of the door outer panel P, rain water or water for washing can not enter into the switch unit 10, or water can not enter the truck lid via the mounting opening P1. In this case, since the lip portion 34 of the cover member 30 is squashed between the plate portion 21 and the door outer panel P, water is further reliably prevented from entering through the mounting opening P1.

According to the latch release operating apparatus, members or portions projecting from the outer surface S1 of the door outer panel P to the outside are only the plate portion 21 of the base member 20 that receives the switch unit 10 in the receiving recess portion 23, and the cover member 30 that covers the plate portion 21, and the plate portion 21 is disposed along the outer surface S1 of the door outer panel P. Accordingly, cases of the plate portion 21 of the base member 20 or the cover member 30 contacting with a foreign object are substantially excluded at times other than the operation time of the switch unit 10, for example, at the time of maintenance, checking, or washing of the car. Accordingly, even if the cover member 30 is thin to maintain a pressing-down operability of the switch unit 10, damage to the cover member 30 due to contact with a foreign object is prevented, and it is not possible that water enters into the latch release operating apparatus due to damage to the cover member 30.

In this case, since the operation unit 31 is formed so as to project from the base portion 32 of the cover member 30 in a stepping manner, and the plurality of projections 31*a* are formed only on the operation unit 31, it is possible to confirm the operation unit 31 easily by a finger tip of a user. Therefore, as shown in FIG. 1, even though the latch release operating apparatus is located on the door outer panel P face downwards, it is unnecessary to look at the the latch release operating apparatus to operate it. Even though a projection amount of the latch release operating apparatus from the outer surface S1 of the door outer panel P has been suppressed as much as possible, a latch release operation to be performed by a user does not become complicated.

While in the embodiment, the latch release operating apparatus provided at the trunk lid T for opening and closing the trunk room in a vehicle such as a four-wheel automobile has been shown, the present invention is not limited to the embodiment. The invention is also applicable to other constitutions for releasing a latch state of a door.

In the embodiment, while the switch main unit 11 is formed to have an approximately square and thin outer shape, and the switch unit 10 has a thin cylindrical push button 12 projecting from the upper face of the switch main unit 11, the shape and constitution of the switch unit are not limited thereto. It is preferable that a switch unit applied to a latch release operating apparatus of the present invention be thin, to reduce the projection amount of the switch unit from the door outer panel P as much as possible.

According to the present invention, even if the cover member is formed to be thin to maintain an excellent pressing-down operability of the switch unit, the cover member is prevented from being easily damaged.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2004-354534, filed Dec. 7, 2004, which is incorporated herein by reference in its entirety.

What is claimed is:

1. A latch release operating apparatus comprising:

a switch unit that includes a switch main unit having a push button, wherein the switch unit is configured to be turned ON for releasing a latch state of a door when the push button is pressed down with respect to the switch main unit;

a base member that holds the switch unit via the switch main unit such that the push button faces the outside from a surface of the base member; and a cover member that is waterproof, that is attached on the surface of the base member, and that covers the push button;

wherein a peripheral edge of the cover member is held with contact pressure between the base member and a door outer panel, and the switch unit is mounted on the door outer panel via the base member such that the push button is operable from an outside of the door outer panel via the cover member.

2. The latch release operating apparatus according to claim 1, wherein the cover member includes:

a base portion that covers the surface of the base member, and an operation unit that is configured to transmit a pressing force to the push button, wherein a step is formed between the base portion and the operation unit.

3. The latch release operating apparatus according to claim 1, wherein the cover member includes:

a base portion that covers the surface of the base member, and an operation unit that is configured to transmit a pressing operation force to the push button, wherein a surface of the operation unit and a surface of the base portion are given different treatment, to make the surfaces different to touch.

4. The latch release operating apparatus according to claim 3, wherein the surface of the base portion is smooth, and the surface of the operation unit is provided with a plurality of projections.

5. The latch release operating apparatus according to claim 1 further comprising:

a leaf spring member that is interposed between the door outer panel and spring retaining portions arranged on a box portion of the base member, wherein the leaf spring member includes distal end spring portions having a distance between the distal end spring portions such that the box portion of the base member can be disposed therebetween, while a plate portion and the spring retaining portions cannot be inserted therebetween.

6. The latch release operating apparatus according to claim 5, wherein each distal end spring portion has a height, larger than a flexing distance, from a back face of the plate portion to a spring retaining portion in a normal state.

7. The latch release operating apparatus according to claim 1, wherein the switch unit is attached to the door outer panel such that the push button faces downward.

* * * * *